United States Patent [19]

Mathis et al.

[11] 4,223,996

[45] Sep. 23, 1980

[54] APPARATUS FOR MIXING SOLID AND LIQUID CONSTITUENTS OF MORTAR OR THE LIKE

[75] Inventors: Paul Mathis, Merdingen; Max Zimmer, Efringen-Kirchen, both of Fed. Rep. of Germany

[73] Assignee: Mathis Fertigputz GmbH, Merdingen, Fed. Rep. of Germany

[21] Appl. No.: 884,409

[22] Filed: Mar. 8, 1978

[30] Foreign Application Priority Data

Mar. 9, 1977 [DE] Fed. Rep. of Germany ..... 2710215
Mar. 9, 1977 [DE] Fed. Rep. of Germany ... 7707226[U]

[51] Int. Cl.³ ..... B28C 1/16; B28C 5/14

[52] U.S. Cl. ..... 366/27; 366/35; 366/38; 366/319; 366/322

[58] Field of Search ..... 366/20, 27, 24, 35, 366/38, 50, 64, 157, 156, 319, 322, 323, 290, 318

[56] References Cited

U.S. PATENT DOCUMENTS

| | | | |
|---|---|---|---|
| 1,563,101 | 11/1925 | Offenhauser | 366/290 |
| 2,813,704 | 11/1957 | MacKissic | 366/290 |
| 3,130,070 | 4/1964 | Potters | 366/319 |

FOREIGN PATENT DOCUMENTS

| | | | |
|---|---|---|---|
| 710208 | 5/1965 | Canada | 366/20 |

*Primary Examiner*—Robert W. Jenkins
*Attorney, Agent, or Firm*—Peter K. Kontler

[57] ABSTRACT

Apparatus for mixing metered quantities of cement with metered quantities of water has a horizontal housing with a first section having an inlet for admission of cement, a cylindrical intermediate section which receives cement from the first section, and a mixing chamber which receives cement from the intermediate section and further receives metered quantities of water by way of a pipe. A feed screw is rotatably mounted in the first and intermediate sections to convey cement toward and into the mixing chamber. The thread of the feed screw carries radially outwardly extending paddles which are located in the first section and prevent accumulations of cement in the space around the corresponding portion of the feed screw. The mixing chamber is connected to the intermediate section by a hinge and contains a rotary mixing element whose shaft is separably coupled to the core of the feed screw. The mixing element can be withdrawn from the mixing chamber upon lifting of a cover which partially overlies the outlet opening of the mixing chamber, whereupon the mixing chamber is pivotable to a position for convenient cleaning of its interior.

32 Claims, 5 Drawing Figures

APPARATUS FOR MIXING SOLID AND LIQUID CONSTITUENTS OF MORTAR OR THE LIKE

BACKGROUND OF THE INVENTION

The present invention relates to improvements in apparatus for mixing granular and/or pulverulent solid constituents with liquids, especially to improvements in apparatus for mixing cement or the like with water. More particularly, the invention relates to improvements in apparatus for continuously mixing flowable solid constituents with liquids. Still more particularly, the invention relates to improvements in apparatus of the type wherein a rotary feed screw delivers metered quantities of a solid constiutent into a mixing chamber where the solid constituent is contacted by a liquid constituent.

It is already known to utilize a rotary feed screw as a means for admitting metered quantities of cement or the like into a mixing chamber wherein the solid constituent is intimately mixed with water or the like. The feed screw comprises a solid core or shaft which carries a continuous helical thread. Alternatively, the solid constituent is fed by hollow screws which resemble a helix. A drawback of presently known apparatus is that the rotating feed screw is likely to dig a tunnel in the supply of admitted solid constituent and that the material around such tunnel forms a stagnant cylindrical body which is not advanced into the mixing chamber. This affects the accuracy of the metering action and/or causes undesirable classification of ingredients of the solid constituent. Furthermore, and since the solid constituent is constituted by or normally contains hygroscopic ingredients, the stagnant body of solid material around the feed screw is likely to form a cake which contaminates the apparatus and must be removed, at intervals, in a time-consuming operation.

OBJECTS AND SUMMARY OF THE INVENTION

An object of the invention is to provide an apparatus for the preparation of mortar or the like wherein the accumulation of solid constituent upstream of a the mixing chamber is prevented in a simple and effective manner.

Another object of the invention is to provide an apparatus which is constructed and assembled in such a way that the mixing chamber can continuously receive metered quantities of the solid constituent.

A further object of the invention is to provide the apparatus with novel and improved conveying means for delivery of the solid constituent into the mixing chamber.

An additional object of the invention is to provide the apparatus with novel and improved means for facilitating time-saving and thorough cleaning of the mixing chamber.

Another object of the invention is to provide an apparatus which is constructed and assembled in such a way that the solid constituent can be contacted by the liquid constituent solely in the mixing chamber.

An additional object of the invention is to provide an apparatus wherein all rotary or other moving parts receive motion from a single prime mover.

Another object of the invention is to provide an apparatus which can furnish a continuous supply of a uniform mixture of solid and liquid constituents for any desired period of time.

A further object of the invention is to provide an apparatus which is constructed and assembled in such a way that it can discharge a homogeneous mixture of solid and liquid constituents at any desired rate.

Another object of the invention is to provide an apparatus which can be used as a superior substitute for presently known mortar mixing apparatus at larger or smaller construction sites and which (especially its section or sections for reception and conveying of the solid constituent) requires less frequent cleaning and dismantling than heretofore known apparatus.

The apparatus which embodies the present invention is utilized for mixing of flowable solid (pulverulent and/or granular) and liquid constituents, such as cement and water. It comprises a preferably elongated and preferably substantially horizontal housing or casing including a first section having inlet means for admission of the solid constituent, a preferably cylindrical intermediate section one end of which communicates with the first section, and a third section or mixing chamber which communicates with the other end of the intermediate section and includes suitable mixing means (e.g., one or more undulate stirrers) for converting the solid and liquid constituents into a homogeneous mixture which issues by way of one or more outlet openings in the mixing chamber. The apparatus further comprises one or more pipes or other suitable means for admitting metered quantities of the liquid constituent into the mixing chamber, and means for conveying the solid constituent from the first housing section into the mixing chamber via the intermediate housing section. The conveying means comprises a rotary feed screw which is journalled in the housing and extends through the interior of the first and intermediate sections, and the feed screw comprises a helical thread and paddles, blades or analogous agitating elements which are supported by and extend radially outwardly from the thread and are welded or otherwise secured to adjacent portions of the thread. The agitating elements may be disposed in planes which are inclined with respect to the planes of the adjacent portions of the thread; for example, such agitating elements may be disposed in planes making right angles with the planes of the neighboring portions of the thread. The agitating elements are preferably angularly offset with respect to each other, as considered in the circumferential direction of the feed screw, and they may together constitute a composite second thread which surrounds the first mentioned thread and tends to advance the solid constituent in a direction counter to that pointing toward and into the intermediate section of the housing, i.e., in a direction toward the upstream end of the feed screw.

The agitating elements effectively destroy any accumulations of solid constituent which tend to form a tube around the thread of the feed screw of the conveying means, whereby the accumulations collapse and move into the range of the thread of the feed screw to be introduced into the mixing chamber.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
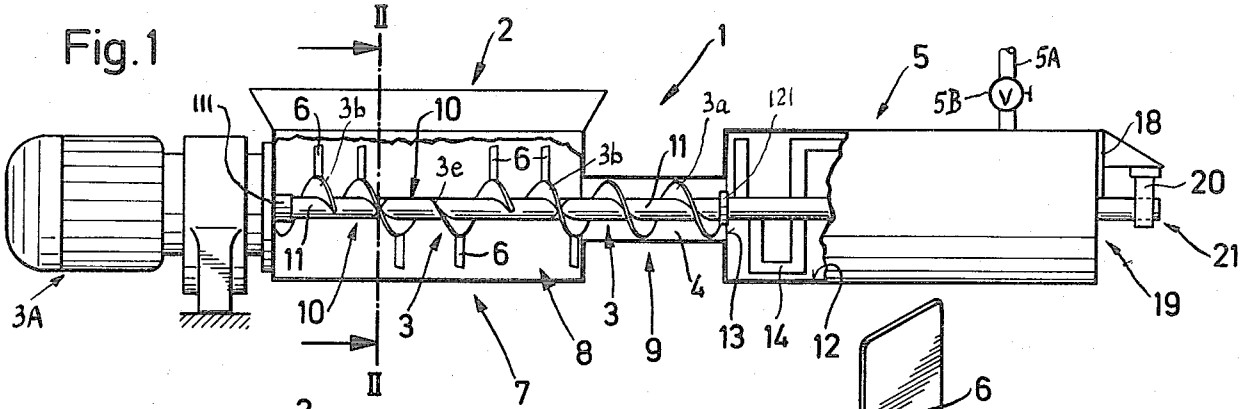
FIG. 1 is a partly elevational and partly sectional view of an apparatus which embodies the invention.
Figure 2:
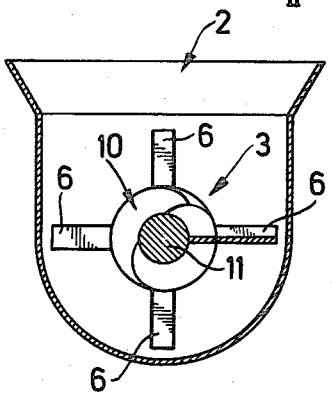
FIG. 2 is an enlarged transverse vertical sectional view as seen in the direction of arrows from the line II—II of FIG. 1.

The apparatus which is shown in FIGS. 1 to 5 comprises a horizontal housing or casing 1 for a feed screw 3. The housing 1 includes a first section or chamber 7, an intermediate or metering section 9 and a mixing section or chamber 5. The apparatus serves for continuous production of mortar which issues from an outlet opening 19 of the mixing chamber 5 and can be fed to several locations at a construction site or the like. The solid constituent (e.g., pulverulent cement) is fed to the section 7 by way of a funnel-shaped inlet 2. Such solid constituent can be admitted in a manner as disclosed in our commonly owned copending application Ser. No. 690,276 filed May 26, 1976, now U.S. Pat. No. 4,117,547, or in any other suitable way. For example, the solid constituent can be admitted by hand, e.g., having a workman empty the contents of bags at regular or required intervals. The arrangement is preferably such that the inlet 2 is located at the upper end of the first section 7.

The feed screw 3 the solid constituent from the section 7 and conveys the material through a relatively narrow channel 4 of the cylindrical intermediate section 9 and into the interior of the mixing chamber 5 which receives metered quantities of water by way of a pipe 5A. The pipe 5A contains a valve 5B which can be actuated to regulate the rate of admission of the liquid constituent. For example, the valve 5B can be adjusted automatically in dependency on the RPM of the motor 3A which drives the feed screw 3.

Figure 3:
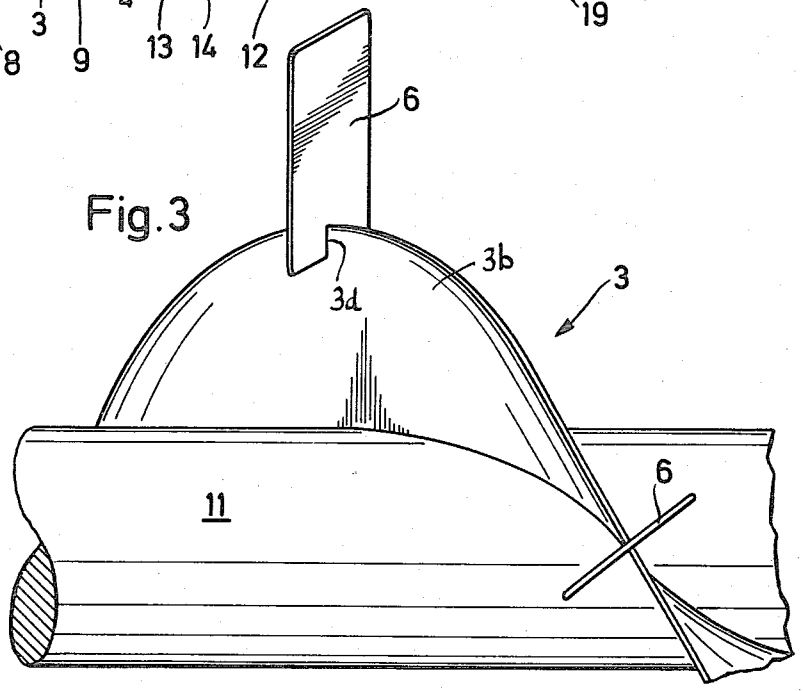
FIG. 3 is a greatly enlarged elevational view of a portion of the feed screw and of two of the agitating elements.

A helical thread **3*a* of the feed screw 3 is attached to a core or shaft 11 which is driven by a motor 3A. In accordance with a feature of the invention, the thread 3*a* carries agitating elements in the form of blades or paddles 6 which extend radially outwardly from the thread 3*a* and are installed in the first section 7 to reach and agitate that portion of the supply of the solid constituent which is located radially outwardly of the thread 3*a*. The paddles 6 may but need not be uniformly distributed along the full length of the first section 7. In order to enhance the accumulation-destroying action of the paddles 6, the planes of these paddles are preferably oriented in a manner as shown in FIG. 3, i.e., the planes of the paddles 6 are disposed substantially at right angles to the planes of the adjacent portions of the thread 3*a*. It can be said that the composite thread which consists of the paddles 6 tends to advance the solid constituent in a direction away from the section 9, i.e., toward the upstream end of the feed screw 3. FIG. 3 further shows that the inner portions of the paddles 6 extend into recesses or notches 3*d* of the adjacent portions of the thread 3*a*. It is clear that the manner of mounting the paddles 6 can be varied in a number of ways, for example, by providing notches in the inner portions of the paddles 6. Each paddle 6 is welded or otherwise permanently or separably but fixedly secured to the adjacent portion of the thread 3*a* in the section 7. The paddles 6 are angularly offset with respect to each other, as considered in the circumferential direction of the feed screw 3**.

It is preferred to provide the paddles 6 at least on that portion of the thread **3*a* which is located below the inlet 2. A lower portion 8 of the section 7 resembles a trough having a substantially semicylindrical shape and being in communication with a duct-shaped upper portion bounded by parallel walls. The tips of the paddles 6 preferably extend close to the inner side of the portion 8 (see FIG. 2). That portion of the feed screw 3 which extends through the intermediate section 9 is not provided with any paddles, and the inner diameter of the section 9 is only slightly larger than the outer diameter of the thread 3*a* in the section 9. Thus, all particles of the solid constituent which enter the section 9 are compelled to advance through the outlet 13 of this section and into the mixing chamber 5**.

The paddles 6 invariably prevent the formation of a hollow cylindrical body of solid constituent in the section 7, i.e., the paddles cause eventual accumulations in the regions surrounding the thread **3*a* to collapse and to enter into the range of the thread 3*a* to be advanced into the channel 4 of the intermediate section 9. In addition, the paddles 6 perform a desirable mixing or stirring action. It is clear that the paddles 6 need not necessarily resemble or constitute flat plates, i.e., they may have a semicylindrical, undulate or other shape without departing from the spirit of the invention. All that is necessary is to insure that the paddles 6 extend radially beyond the thread 3*a* of the feed screw 3 in order to reach possible accumulations of the solid constituent in those portions (including 8) of the interior of the section 7 which cannot be reached by the thread 3*a*. In fact, the paddles 6 need not be inclined with respect to the adjacent portions of the thread 3*a*; the inclination shown in FIG. 3 (or a similar inclination) merely enhances the agitating and mixing action of paddles in the section 7**.

FIG. 1 further shows that the thread **3*a* on that portion of the core 11 which extends through the section 7 is not a continuous helix, i.e., the thread is interrupted at one or more locations (shown at 10), as considered in the longitudinal direction of the feed screw 3, in order to provide room for descent of the solid constituent from the inlet 2 and all the way to the core 11. This also promotes the transport of the solid constituent into the intermediate section 9. For example, an interruption or gap 10 can be provided between successive thread portions 3*b* each of which extends along an arc of 360 degrees, as considered in the circumferential direction of the feed screws. Each thread portion or convolution 3*b* (between two neighboring gaps 10) can carry one or more paddles 6. The paddles 6 on each preceding convolution 3*b* of the thread 3*a* urge the solid material into the gap 10 therebehind, and such material is thereupon entrained by the thread 3*a* and advanced into the channel 4 of the section 9 for transport into the mixing chamber 5. That portion of the thread 3*a* which rotates in the section 9 is uninterrupted to thus insure that the chamber 5** receives identical quantities of solid constituent per unit of time (as long as the motor 3A drives the core 11 at a constant speed and the section 7 contains a requisite supply of the solid constituent).

The material of the thread 3*a* and the paddles 6 is preferably a wear-resistant metal, most preferably steel.

The leading and trailing edges (at least the trailing edges) of the convolutions 3*b* between the gaps 10 in the section 7 are preferably sharpened to resemble knife blades. This contributes to a more satisfactory material entraining action of the convolutions 3*b*. One such blade-like portion is shown at 3*e* in FIG. 1.

FIG. 1 further shows that a bottom portion 12 of the mixing chamber 5 is located at a level below the intermediate section 9. The same applies for the lower portion 8 of the section 7. Liquid which is admitted via the pipe 5A descends first into the bottom portion 12 and is thus prevented from flowing counter to the direction of admission of the solid constituent, i.e., the liquid cannot enter the section 7 and/or 9. Were the bottom portion 12 located at the level of the intermediate section 9, the latter could receive some liquid during stoppage of the motor 3A. The likelihood of liquid flow into the section 9 and/or 7 is further reduced due to the fact that the volume of the mixing chamber 5 exceeds the volume of the intermediate section 9. In fact, the capacity of the bottom portion 12 of the mixing chamber 5 can be selected in such a way that it can receive and store the liquid which remains in the chamber 5 when the motor 3A is idle. The cross-sectional area of the section 9 (channel 4) is less than that of the section 7 or mixing chamber 5.

As disclosed in the aforementioned commonly owned copending application Ser. No. 690,276, now U.S. Pat. No. 4,117,547, the mixing chamber 5 is not or need not be filled to capacity, i.e., the rate at which the mixture is withdrawn from the chamber 5 via outlet opening 19 equals the rate of admission of solid and liquid constituents. This also reduces the likelihood of liquid flow into the section 9. As a rule, the rate at which the mixing chamber 5 receives solid and liquid constituents is such that the interior of the chamber 5 is filled to not more than 50 percent of its capacity.

Experiments indicate that the improved apparatus operates properly regardless of whether the feed screw 3 is rotated continuously or at intervals. Those paddles 6 which are close to the intermediate section 9 tend to move the solid constituent in the outer zones of the interior of the section 7 in a direction to the left, as viewed in FIG. 1, i.e., below the inlet 2, where the material descends into the gaps 10 and is thereupon conveyed toward and into the channel 4. The paddles 6 below and to the left of the inlet 2 also tend to advance the solid constituent in a direction to the left and thereby effectively prevent accumulations of such material along the corresponding portions of the inner side of the section 7 with the result that the period of dwell of each batch of the solid constituent in the section 7 is relatively short. This insures that the hydroscopic material in the section 7 is not likely to withdraw moisture from surrounding air and to harden along the inner side of the section 7.

The feed screw 3, in cooperation with its paddles 6, insures that the intermediate section 9 receives the solid constituent at a constant rate, i.e., the section 9 can admit metered quantities of the solid constituent into the mixing chamber 5. The outer diameter of the thread 3*a* in the chamber 4 preferably equals the outer diameter of the (interrupted) thread 3*b* in the section 7.

The provision of gaps 10 between the portions 3*b* of the thread 3*a* in the section 7 exhibits several important advantages. Thus, the solid constituent which is admitted via the inlet 2 can descend all the way to the periphery of the core 11 and is invariably entrained for movement toward and into the channel 4. Were the thread 3*a* in the section 7 continuous, the helical groove between such thread and the periphery of the core 11 would be likely to become clogged with the solid constituent so that the feed screws would be unable to deliver solid material into the channel 4 at a predictable rate. The material which happens to move radially outwardly via the gaps 10 (i.e., toward the inner side of the section 7) is engaged and stirred by the paddles 6 and is returned into the range of the thread 3*a*. The provision of a continuous thread 3*a* in the channel 4 is desirable in order to insure that the outlet 13 discharges uniform quantities of solid material.

An advantage of the heretofore described parts of the improved apparatus is that they are relatively simple and can stand long periods of use. It has been found that the wear upon the parts of the apparatus is especially low if the prime mover 3A is operated at a constant speed. It has also been found that the ratio of liquid to solid constituent in the mixture which issues from the mixing chamber 5 via outlet opening 19 is at least substantially constant, i.e., the metering action of the apparatus is highly satisfactory.

The mixing chamber 5 confines a rotary undulate mixing element 14 having a shaft 21. The core 11 drives the shaft 21 by way of a separable coupling 121. The shaft 21 extends outwardly beyond the outlet opening 19 of the mixing chamber.

Figure 4:
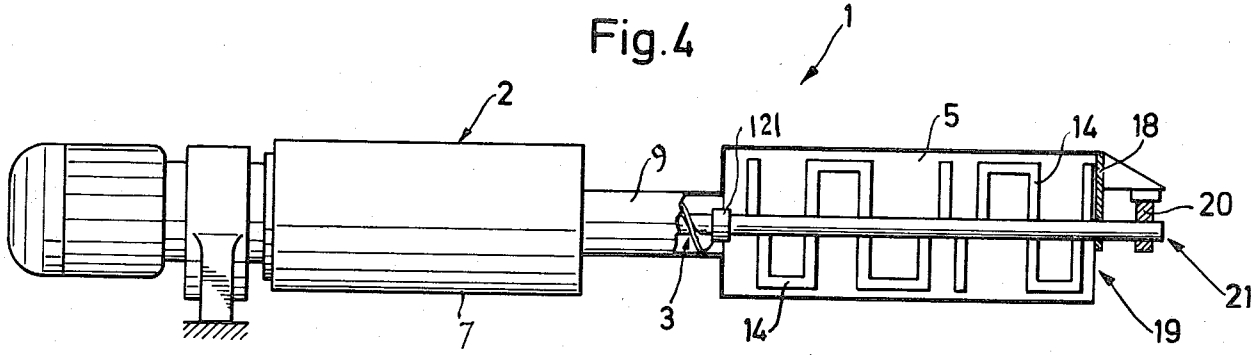
FIG. 4 illustrates the apparatus of FIG. 1, with the mixing chamber in vertical section.
Figure 5:
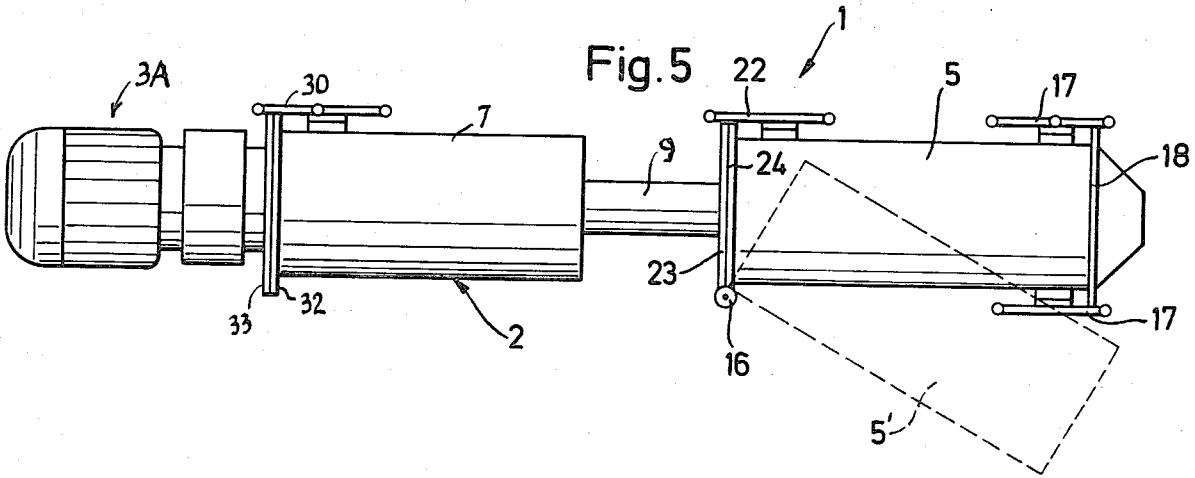
FIG. 5 is a plan view of the structure shown in FIG. 1 or 4, the inoperative position of the mixing chamber being indicated by broken lines.

FIGS. 4 and 5 show that the mixing chamber 5 is articulately connected to the section 9 by a hinge 16 whose axis is normal to and crosses in space with the axis of the core 11. Pivoting of the mixing chamber 5 about the pintle of the hinge 16 to the broken-line inoperative position 5′ of FIG. 5 can take place when the coupling 121 is disengaged so that the mixing element 14 can move relative to the feed screw 3. The pintle of the hinge 16 is vertical.

The mixing chamber 5 carries a retractible cover 18 which overlies a portion of the outlet opening 19 at the right-hand end of the mixing chamber 5. The outlet opening 19 discharges the mixture into a suitable receptacle, not shown. The cover 18 carries a bearing 20 for the shaft 21 of the mixing element 14. When the mixing chamber 5 is to be moved from the operative position of FIG. 4 to inoperative position 5′, the locking device or devices 17 for the cover 18 are loosened so that the cover 18 can be lifted from the first position of FIG. 4 and all the way to a second position above the outlet opening 19. At the same time, the bearing 20 is disengaged from the shaft 21. The mixing element 14 is then ready to be withdrawn from the mixing chamber 5 via the opening 19 and the mixing chamber t is thereupon ready to be pivoted upon loosening of a suitable locking device 22. The locking devices 17 and 22 are preferably of the quick-release type to insure that little time is wasted for lifting the cover 18 and movement of the mixing chamber 5 to the position 5′ or vice versa. It is also possible to resort to screws, bolts and nuts or like locking devices. When in the position 5′, the mixing chamber 5 can be readily cleaned, e.g., by sprays of water, to remove remnants of the solid constituent and/or remnants of the mixture which remained in the chamber 5 on stoppage of the motor 3A.

The illustrated apparatus can be modified by mounting the mixing chamber 5 for pivotal movement about a horizontal axis which is located at a level below the shaft 21. This insures that the mixing chamber moves to the position 5' by gravity as soon as the cover 18 is lifted, the shaft 21 of the mixing element 14 is removed, and the locking device 22 is deactivated. In each embodiment, the cover 18 is preferably movable up and down. The orientation of the pintle of the hinge 16 will be selected in dependency on the availability of space around the mixing chamber 5.

It has been found that the just described pivotal mounting of the mixing chamber 5 allows for frequent and thorough cleaning of the mixing chambers with little loss in time. In fact, all parts of the apparatus, with the single exception of the mixing element 14, can remain attached to each other when the mixing chamber 5 is moved to the position 5'.

FIG. 5 further shows that the hinge 16 is mounted on a flange 23 which is disposed at the discharge end 13 of the intermediate section 9. The mixing chamber 5 has a similar flange 24 which abuts against the flange 23 when the mixing chamber 5 is returned to operative position. The flanges 23 and 24 insure adequate sealing of the housing in the region between the section 9 and the mixing chamber 5. The flange 23 carries the locking device 22.

The advantages of a mixing chamber which is pivotable or otherwise movable between operative and inoperative positions will be readily appreciated by considering that the mixing of ingredients of mortar results in certain reactions and the mixture is likely to accumulate in the region of the outlet 13 of the intermediate section 9 to form a hard crust, especially during prolonged stoppage of the prime mover 3A (this prime mover may constitute a variable-speed electric motor). Incrustation is attributable to the fact that the mixing of liquid and solid constituents in the region immediately adjacent to the outlet 13 of the channel 4 is less likely than in the remaining parts of the internal space of the mixing chamber. Possible accumulations of incrustated matter at the outlet 13 could interfere with predictable admission of the solid constituent into the mixing chamber 5. By moving the mixing chamber 5 to the position 5', a workman can readily inspect the interior of the entire mixing chamber 5 and can remove eventual accumulations of crusts therein. Since the movement of the mixing chamber 5 to the inoperative position is preceded by withdrawal of the mixing element 14, the latter, too, can be inspected and cleaned (if necessary) prior to moving the mixing chamber 5 back to the operative position. Thus, the movability of mixing chamber 5 between the positions shown in FIG. 5 insures that a workman can inspect the mixing element 14 as well as that the workman can reach and inspect that portion of the mixing chamber 5 (adjacent to the outlet 13 of the section 9) which is most likely to accumulate incrustations of solid constituent. If the mixing chamber 5 is pivotable about a vertical axis, the material which remains therein at the flange 24 can be removed from one side or from above. The evacuation of such material is even more convenient if the axis of the pintle in the hinge 16 is horizontal and the hinge 16 is located at a level below the outlet 13. At least some solid material which remained in the mixing chamber 5 is then likely to be evacuated by gravity as soon as the chamber 5 moves to the inoperative position or upon loosening of incrustations by resorting to a suitable tool.

The construction which is shown in FIG. 5 is practical not only because it allows for rapid movement of the mixing chamber 5 to the inoperative position and for rapid withdrawal of the mixing element 14, but also because such parts can be rapidly returned to their operative positions.

A locking device 30 of FIG. 5 releasably secures the section 7 to the housing of the prime mover 3A. When the section 7 is held in the operative position of FIG. 5, its flange 32 abuts against a flange 33 of the housing of the prime mover 3A. A coupling 111 between the output element of the primer mover 3A and the core 11 must be disengaged before the section 7 (with the section 9) can be pivoted to the inoperative position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for mixing flowable solid and liquid constituents, such as cement and water, comprising a housing including a first section having inlet means for admission of the solid constituent, and intermediate section communicating with said first section, and a mixing chamber communicating with said intermediate section; means for admitting the liquid constituent into the interior of said mixing chamber; and means for conveying the solid constituent from said first section into said mixing chamber via said intermediate section, including a rotary feed screw journalled in said housing and extending through the interior of said sections, and feed screw comprising a helical thread having at least two discrete portions which are separated by a gap in said first section.

2. Apparatus as defined in claim 1, wherein said portions of said thread extend along arcs of approximately 360 degrees, as considered in the circumferential direction of said feed screw.

3. Apparatus as defined in claim 1, wherein said feed screw further comprises a continuous core supporting said thread and extending through the interior of said sections.

4. Apparatus as defined in claim 1, wherein said thread is continuous in the interior of said intermediate section.

5. Apparatus as defined in claim 1, wherein said intermediate section is a hollow cylinder where inner diameter slightly exceeds the outer diameter of the respective portion of said thread.

6. Apparatus as defined in claim 5, wherein the outer diameter of said thread in said first section equals the outer diameter of said thread in said cylinder.

7. Apparatus as defined in claim 1, wherein said thread comprises a plurality of discrete convolutions in said first section and said convolutions have sharp trailing edges, as considered in the direction of transport of the solid constituent toward and into said intermediate section.

8. Apparatus as defined in claim 1, wherein the cross-sectional area of said mixing chamber exceeds the cross-sectional area of said intermediate section.

9. Apparatus as defined in claim 8, wherein said mixing chamber includes a bottom portion located at a level below said intermediate section.

10. Apparatus as defined in claim 1, wherein the cross-sectional area of said first section exceeds the cross-sectional area of said intermediate section.

11. Apparatus as defined in claim 1, wherein the volume of said mixing chamber exceeds the volume of said intermediate section.

12. Apparatus as defined in claim 1, wherein said mixing chamber comprises at least one portion which is movable between an open and a closed position.

13. Apparatus as defined in claim 1, wherein said feed screw further includes agitating elements secured to and extending radially outwardly beyond said thread.

14. Apparatus as defined in claim 13, wherein said agitating elements include paddles disposed in planes which are inclined with respect to the planes of the adjacent portions of said thread.

15. Apparatus as defined in claim 13, wherein said agitating elements together constitute a composite second thread which surrounds said first mentioned thread and tends to advance the solid constituent in a direction away from said intermediate section.

16. Apparatus as defined in claim 13, wherein said agitating elements include paddles disposed in planes making angles of approximately 90 degrees with the planes of adjacent portions of said thread.

17. Appartus as defined in claim 13, wherein said agitating elements are angularly offset with respect to each other, as considered in the circumferential direction of said feed screw.

18. Apparatus as defined in claim 13, wherein said agitating elements are welded to said thread.

19. Apparatus as defined in claim 13, wherein said thread has recesses for portions of said agitating elements.

20. Apparatus as defined in claim 13, wherein said agitating elements have recesses for the adjacent portions of said thread.

21. Apparatus as defined in claim 13, wherein said thread and said agitating elements consist of steel.

22. Apparatus for mixing flowable solid and liquid constituents, such as cement and water, comprising a housing including a first section having inlet means for admission of the solid constituent, an intermediate section communicating with, and having a cross-sectional area smaller than that of, said first section, and a mixing chamber communicating with said intermediate section; means for admitting the liquid constituent into the interior of said mixing chamber; and means for conveying the solid constituent from said first section into said mixing chamber via said intermediate section, including a rotary feed screw journalled in said housing and including a helical thread extending through the interior of said sections and snugly surrounded by said intermediate section.

23. Apparatus for mixing flowable solid and liquid constituents, such as cement and water, comprising a housing including a first section having inlet means for admission of the solid constituent, an intermediate section communicating with said first section, and a mixing chamber communicating with said intermediate section and having an outlet opening for the mixture of solid and liquid constituents and a cover movable relative to said outlet opening between first and second positions in which said cover respectively overlies and exposes said outlet opening; means for admitting the liquid constituent into the interior of said mixing chamber; and means for conveying the solid constituent from said first section into said mixing chamber via said intermediate section, including a rotary feed screw journalled in said housing and including a helical thread extending through the interior of said sections.

24. Apparatus for mixing flowable solid and liquid constituents, such as cement and water, comprising a housing including a first section having inlet means for admission of the solid constituent, an intermediate section communicating with said first section, and a mixing chamber communicating with said intermediate section and having an outlet opening for the mixture of solid and liquid constituents and a cover movable between a first position in which said opening and a second position in which said opening is fully exposed; means for admitting the liquid constituent into the interior of said mixing chamber; means for conveying the solid constituent from said first section into said mixing chamber via said intermediate section, including a rotary feed screw journalled in said housing and including a helical thread extending through the interior of said sections, a rotary mixing element in said mixing chamber; and a bearing for said mixing element, said bearing being mounted on said cover and being operative to support said mixing element in said first position of said cover.

25. Apparatus for mixing flowable solid and liquid constituents, such as cement and water, comprising a housing including a first section having inlet means for admission of the solid constituent, an intermediate section communicating with said first section, and a mixing chamber communicating with said intermediate section; means for movably securing said mixing chamber to said intermediate section; means for admitting the liquid constituent into the interior of said mixing chamber; and means for conveying the solid constituent from said first section into said mixing chamber via said intermediate section, including a rotary feed screw journalled in said housing and including a helical thread extending through the interior of said sections.

26. Apparatus as defined in claim 25, wherein said outlet opening is aligned with and spaced apart from said intermediate section and further comprising means for releasably locking said cover in said first position.

27. Apparatus as defined in claim 26, further comprising a rotary mixing element in said chamber, said mixing element being removable from and insertable into said chamber via said outlet opening in said second position of said cover.

28. Apparatus as defined in claim 26, wherein said mixing element is coaxial with said feed screw and further comprising means for releasably coupling said mixing element to said feed screw.

29. Apparatus as defined in claim 26, wherein said cover comprises a bearing for a portion of said mixing element, said bearing being operative to support said portion of said mixing element in said first position of said cover.

30. Apparatus as defined in claim 25, wherein said securing means includes a hinge and said mixing chamber is pivotable between an operative and inoperative position, and further comprising means for releasably locking said chamber in said operative position.

31. Apparatus as defined in claim 30, wherein said hinge defines a substantially horizontal pivot axis for said mixing chamber, said mixing chamber being movable to said inoperative position by gravity upon disengagement of said locking means.

32. Apparatus as defined in claim 30, wherein said intermediate section includes a first annular flange and said mixing chamber includes a second annular flange which abuts against said first flange in said operative position of said chamber.

* * * * *